US005554196A

United States Patent [19]

Wielstra

[11] Patent Number: 5,554,196

[45] Date of Patent: Sep. 10, 1996

[54] METHOD OF MARKING A SURFACE OF AN OBJECT BY MEANS OF A LASER LIGHT

[75] Inventor: Ytsen Wielstra, Eindhoven, Netherlands

[73] Assignee: U.S. Philips Corporation, New York, N.Y.

[21] Appl. No.: 509,808

[22] Filed: Aug. 1, 1995

Related U.S. Application Data

[63] Continuation of Ser. No. 248,947, May 25, 1994, abandoned.

[30] Foreign Application Priority Data

May 26, 1993 [EP] European Pat. Off. ..... 93201505

[51] Int. Cl.[6] ..... D06P 1/02; D06P 3/00; D06P 5/20

[52] U.S. Cl. ..... 8/444; 8/506; 8/552; 8/571; 8/574; 8/593; 8/605; 8/616; 8/649; 8/670; 8/115.52; 8/115.53; 8/920

[58] Field of Search ..... 8/444, 506, 552, 8/571, 574, 602, 605, 616, 649, 115.52, 115.54, 593, 670, 115.53, 920

[56] References Cited

U.S. PATENT DOCUMENTS

| | | | |
|---|---|---|---|
| 3,146,348 | 8/1964 | Workman | 250/65 |
| 3,149,990 | 9/1964 | Coles et al. | 117/36.8 |
| 4,207,111 | 6/1980 | Fujiwhara et al. | 430/376 |
| 4,430,420 | 2/1984 | Adin | 430/351 |
| 4,433,037 | 2/1984 | DoMinh | 430/19 |
| 4,742,042 | 5/1988 | Hiraishi et al. | 503/201 |

FOREIGN PATENT DOCUMENTS 974345 11/1964 United Kingdom .

OTHER PUBLICATIONS

Justus Liebigs *Annalen Der Chemie*, "Quartäre Heterocylische Azosulfone", Hünig et al., 1966, pp. 116–139. No Month Available.

*Primary Examiner*—Paul Lieberman
*Assistant Examiner*—Caroline L. Dusheck
*Attorney, Agent, or Firm*—Ernestine C. Bartlett

[57] ABSTRACT

Method of marking a surface of an object by means of a laser light beam.

A description is given of a method of decorating or marking, for example, synthetic resin objects by means of an UV-laser or IR-laser by coating the object with a layer of a dye precursor and a coupler in a binder. For the precursor use is made of a heterocyclic mono- or bis-arylsulphonylhydrazone and for the coupler use is made of, for example, an indole, aniline, pyrazoline or malonitrile, so that after irradiation with UV-laser light or IR-laser light an azo-dye (XXX) is formed.

17 Claims, 5 Drawing Sheets

(XXX)

(XL)

METHOD OF MARKING A SURFACE OF AN OBJECT BY MEANS OF A LASER LIGHT

This is a continuation of application Ser. No. 08/248,947, filed May 25, 1994, now abandoned.

FIELD OF THE INVENTION

The invention relates to a method of marking a surface of an object by means of a laser light beam, said surface being coated with a layer of a mixture which comprises at least a binder and a dye precursor, after which the layer is irradiated in accordance with the desired marking by the laser light beam, so that the precursor is converted to a dye in the irradiated areas.

The method in accordance with the invention can be used for marking objects which are at least locally provided with a light-sensitive layer which consists of the above-mentioned mixture. The term "marking" is to be understood to mean herein: the provision of characters such as letters, numbers, symbols, figures, decorations and the like. The objects may be made of, for example metal, glass or synthetic resin. Examples of synthetic resin objects are: housings for domestic appliances and products for personal care such as shavers. Such housings are marked, inter alia, with a type code and are often provided with logos and coloured decorations in the form of lines and areas.

BACKGROUND OF THE INVENTION

Such a method is known from United States Patent document U.S. Pat. No. 4,742,042. In the known method a layer of a mixture consisting of a dye precursor, bis(3-allyl-4-hydroxyphenyl)sulphone as the developer, a heat-sensitive substance (heat sensitizer) and a binder are provided on a support. By locally heating said layer with, for example, a laser a coloured image is formed in said layer.

A disadvantage of the known method is that only the compounds which react with said hydroxyphenyl coupler can be used as dye precursors. According to said Patent document, fluoranes and fluorenes are suitable precursors. The colour of the dyes formed ranges from blue to green. To obtain a mixed colour a second leuco dye must be added to the mixture. In said United States Patent document no description is given of how other colours, such as violet, yellow and orange must be made. A further disadvantage is that said dyes can only be formed in a thermal process, i.e. using infrared radiation, and not in a photochemical process using ultraviolet radiation. A still further disadvantage is that the layer in which the dye is formed must be provided with a protective coating comprising UV-absorbing substances to improve the resistance of the colour image formed against light and other environmental factors.

SUMMARY OF THE INVENTION

It is an object of the invention to provide, inter alia, an alternative method which enables the entire visible colour spectrum to be provided as a marking on a surface by means of a laser and without using a second dye. In this method the dye can be formed both by thermal and photochemical processes, and a protective layer to improve the stability of the colour image can be omitted.

According to the invention, this object is achieved by a method as described in the opening paragraph, which is characterized in that a heterocyclic sulphonyl hydrazone is used as the precursor and in that an organic compound comprising an active hydrogen atom as the coupler is also added to the mixture and in that an azo-dye is formed as the dye. Azo-dyes can be represented by the formula A'—N=N—A" or A'=N—N=A", where A' and A" represent aromatic ring systems. Azo-dyes are in widespread use and can be obtained in any desired colour by varying the ring systems. Said dyes are often prepared by coupling a diazonium salt $A'—N^{+}\equiv N$ as the precursor with a so-called coupler A"—H, i.e. compounds comprising active hydrogen atoms, such as indoles, phenols or anilines. Another method is the oxidative coupling of said couplers with heterocyclic hydrazones A> C=N—$NR_1R_2$, where A is a heterocyclic ring system and $R_1$ and $R_2$ represent a separable group, such as a hydrogen atom. In this method, hydrazone is activated by oxidation. For example, a Fe(III)-salt is used as the oxidation agent.

In accordance with the invention, said azo-dyes can be formed in situ in a thermal process by exposure to IR light if a heterocyclic hydrazone compound comprising two sulphonyl substituents $R_1$ and $R_2$, for example a bis-arylsulphonylhydrazone, a bis-alkylsulphonylhydrazone or an aryl, alkylsulphonylhydrazone, is used as the precursor. Suitable aryl groups are, for example, phenyl, tolyl, naphtyl and anthryl. Suitable alkyl groups are for example $C_1$–$C_{10}$ alkyl groups which may or may not be cyclic. Suitable aromatic sulphonyl substituents are, for example, the phenylsulphonyl group and the tosyl group (—$SO_2.C_6H_5$ and —$SO_2.C_6H_4.CH_3$, respectively). Suitable alkylsulphonyl substituents are, for example, the heptylsulphonyl group and the octylsulphonyl group. Due to the presence of these long alkyl groups, the solubility of the precursor in the binders hereinafter specified is enhanced. This is an important factor in the formation of transparent layers. For the coupling reaction with, for example, an aniline, a phenol or indole no oxidation agent is necessary. Coupling takes place at a temperature above 150° C. This temperature can be attained with a $CO_2$ laser (wavelength 10.6 μm) having a power of 1–10 W/cm$^2$.

For the heterocyclic ring system A of the bis-sulphonylhydrazone use can be made of, for example, the ring systems of 3-alkylbenzothiazole (see formula of FIG. 1A), such as 3-methylbenzothiazole, 4,5-tetramethylene-3-alkylthiazole (formula pf FIG. 1B), 2,4-dialkylthiadiazole (formula of FIG. 1C), 6-alkoxy-3-alkylbenzothiazole (formula of FIG. 1D), 3-alkylthiazoline (formula of FIG. 1E), 1,3-dialkylbenzimidazole (formula of FIG. 1F) or 3-alkylthiazole (formula of FIG. 1G). In said formulas, R represents an alkyl group, for example a methyl group. Other suitable heterocyclic ring systems are N-alkylquinoline, N-alkylpyridine and trialkylindoline. In said ring systems the alkyl groups may be the same or different. Bis-arylsulphonylhydrazones which can suitably be used as the precursor in accordance with the invention are, for example, bis-tosylhydrazone of 3-methylbenzothiazole (see FIG. 3A) and bis-tosylhydrazone of 4,5-tetramethylene-3-methylthiazole (see FIG. 3B).

For the coupler use is made of compounds comprising an active hydrogen atom, such as indoles, for example, 2-alkylindole and 2-arylindole (see formula of FIG. 2A, wherein $R_3$ is an alkyl group or aryl group, for example a methyl group or phenyl group, and $R_4$ is a H-atom or an alkyl group or aryl group), anilines (formula of FIG. 2C, wherein $R_7$ and $R_8$ are a H-atom or an alkyl group, for example a methyl group), active methylene compounds, such as malonitrile (formula of FIG. 2D) and pyrazolines (formula of FIG. 2B, wherein $R_5$ and $R_6$ are an alkyl group or aryl group, for example, a methyl group or phenyl group) and phenols, such as phenol, 2-naphtol and naphtol-AS (formula of FIG. 2E).

For the coupler use is preferably made of indoles (2A) because of the higher resistance to light of the dyes formed when they are used in combination with the hereinafter specified binders.

All colours of the visible spectrum (violet, blue, green, yellow, orange, red) can be obtained by varying the heterocyclic ting system A and the coupler.

The mixture of the precursor, the coupler and a binder is provided in the form of a layer on the surface to be marked of the object. This coating process can be carried out by spraying or spin coating said mixture in a solvent. Suitable binders are 1-component lacquers and 2-component lacquers, such as epoxies, polyurethanes and polymethylmethacrylate, respectively. A suitable solvent is, for example, cyclohexanone. The mixture may contain white pigments, such as $TiO_2$, ZnO or $SiO_2$, or coloured pigments, so that a mixed colour on a coloured background is obtained.

Dependent upon the coupler used, an acid or a base is optionally added to the mixture. By virtue thereof, the coupling reaction, in which an azo-dye is formed, takes place more efficiently, so that the colour strength is improved. When a coupler in accordance with formulae 2A or 2C is used, an acid may be added; when a coupler in accordance with formulae 2B, 2D or 2E is used, a base may be added. Suitable acids are, for example, benzoic acids, such as p-nitrobenzoic acid. An example of a suitable base is diazabicyclo-octane. Said substances dissolve readily in the above-mentioned binders.

The coupling reaction leading to the formation of an azo-dye based on a bis-sulphonylhydrazone can also be carried out by means of UV-light radiation, for example light originating from an excimer laser. In this embodiment, the azo-dye is formed in a photochemical process. In this case, the layer preferably comprises a sensitizer, such as benzophenone, 4,4'-dichlorobenzophenone and 4,4'-difluorobenzophenone. If use is made of UV-light, the omission of said sensitizer causes a reduced conversion to said azo-dye.

Another embodiment of the method in accordance with the invention is characterized in that UV-laser light and a heterocyclic mono-sulphonylhydrazone are used. In this case, $R_1$ in the above-mentioned formula $A>C{=}N{-}NR_1R_2$ of the heterocyclic hydrazone represents an aromatic or alkylsulphonyl substituent and $R_2$ represents a H-atom. For the arylsulphonyl substituent or alkylsulphonyl substituent $R_1$ use can be made of the above-mentioned groups. In this embodiment, the layer also comprises a compound which acts as a sensitizer as a result of exposure to UV-light, said compound being, for example benzophenone, 4,4'-dichlorobenzophenone and 4,4'difluorobenzophenone, and the azo-dye is formed in a photochemical process.

For the heterocyclic ring system A of the mono-sulphonylhydrazone use can be made of the above-mentioned ring systems of FIGS. 1A to 1G. Mono-arylsulphonylhydrazones which can suitably be used as the precursor in accordance with the invention are, for example, mono-tosylhydrazone of 3-methylbenzothiazole (see FIG. 4A) and mono-tosylhydrazone of 4,5-tetramethylene-3-methylthiazole (see FIG. 4B; 4,5-tetramethylene-3- methylthiazolone-(2)- [ ω-p-toluenesulphonylhydrazone]).

If the heterocyclic mono-sulphonylhydrazones are used as the precursor, the above-mentioned couplers and binders can be used.

The method in accordance with the invention can very suitably be used for decorating synthetic resin products. By exposure to laser light, either UV-light or IR-light, the desired decorations or other markings can be provided in the layer. The azo-dyes formed are very resistant to environmental influences such as light and moisture, so that a protective layer can be omitted.

BRIEF DESCRIPTION OF THE DRAWINGS

The invention will be explained in greater detail by means of exemplary embodiments and drawings, in which FIGS. 1A to 1 G show several structural formulas of heterocyclic ring systems of a hydrazone which can suitably be used as a precursor for the formation of azo-dyes.

DETAILED DESCRIPTION OF THE INVENTION

EXEMPLARY EMBODIMENT 1

Figure 4A:
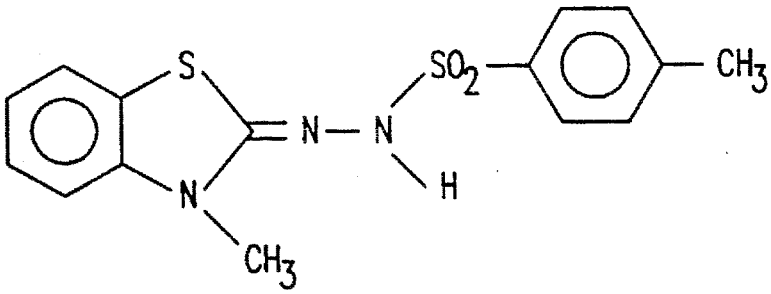
FIG. 4A shows the structural formula of mono-tosylhydrazone of 3-methylbenzothiazole.
Figure 4B:
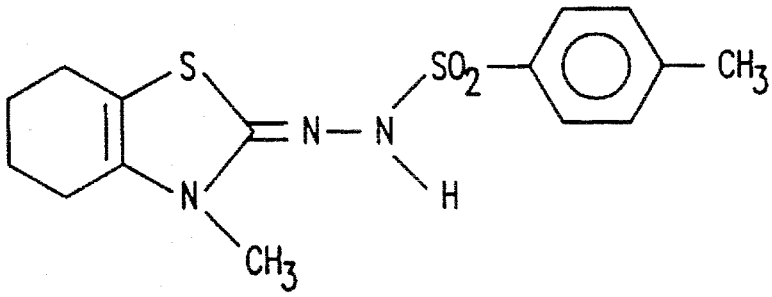
FIG. 4B shows the structural formula of mono-tosylhydrazone of 4,5-tetramethylene-3- methylthiazole.

A. Preparation of mono-tosylhydrazone of 4,5-tetramethylene-3-methylthiazole (structural formula: FIG. 4B)

A quantity of 20 g of 4-methylthiosemicarbazide and 36.5 g of p-toluenesulphonylchloride are dissolved in 100 ml pyridine. After two hours the mixture is suspended in water and the solid is filtrated, washed with ethanol and dried in vacuum. The yield is 37 g of 1-p-toluenesulphonyl-4-methylthiosemicarbazide. Said carbazide is refluxed with 19 g of 2-chlorocyclohexanone in 80 ml of ethanol for 3 hours. The precipitate is filtered and dried in vacuum. The yield is 11 g of the product having the structural formula shown in FIG. 4B.

Figure 3A:
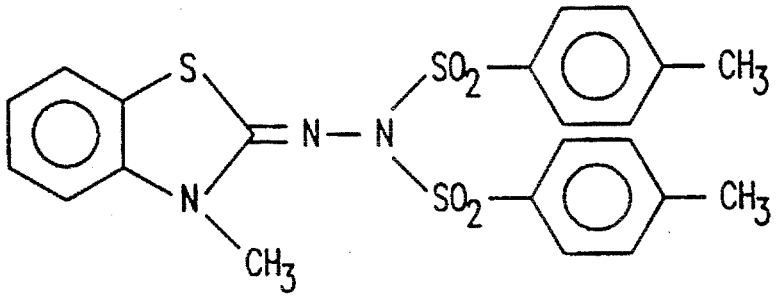
FIG. 3A shows the structural formula of bis-tosylhydrazone of 3-methylbenzothiazole.
Figure 3B:
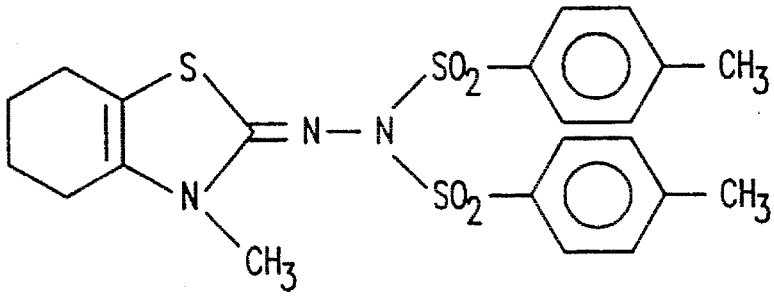
FIG. 3B shows the structural formula of bis-tosylhydrazone of 4,5-tetramethylene-3- methylthiazole.

B. Preparation of bis-tosylhydrazone of 4,5-tetramethylene-3-methylthiazole (structural formula: FIG. 3B)

A quantity of 2 g of the substance prepared in accordance with A (FIG. 4B) is suspended in 10 ml of water. After the addition of 10 ml of 48% fluoroboric acid and cooling with ice, 10 ml of 70% nitric acid is added drop-wise. After stirring for 1 hour, the red precipitate is filtered, washed with water and dried in vacuum. The yield is 1.5 g of the fluoroborate salt of the compound shown in FIG. 4B. A quantity of 1 g of said salt and 0.42 g of sodium-p-toluenesulphinate are stirred in 30 ml of acetonitrile for 12 hours. The resulting white precipitate is collected and dried in vacuum. The yield is 1 g of the product having the structural formula shown in FIG. 3B.

C. Preparation of mono-tosylhydrazone of 3-methylbenzothiazole (structural formula: FIG. 4A)

A quantity of 19 g of 3-methyl-benzothiazolone-( 2)-hydrazone-hydrochloride-hydrate is suspended in 150 ml of N-methylpyrrolidone together with 1 equivalent of p-toluenesulphonylchloride and 1 equivalent of ZnO. After stirring for 6 hours at 90° C., the mixture is poured in water and the white precipitate is filtered-off. The material is purified by dissolving it in alcoholic NaOH and causing it to precipitate with hydrochloric acid. The yield is 12 g.

D. Preparation of bis-tosylhydrazone of 3-methylbenzothiazole (structural formula: FIG. 3A)

This compound was prepared in analogous manner as bis-tosylhydrazone of 4,5-tetramethylene-3-methylthiazole described under B.

Irradiation experiment.

Figure 1A:
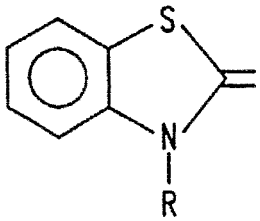
Figure 1B:
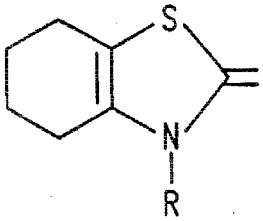
Figure 1C:
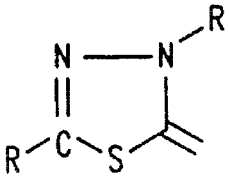
Figure 1D:
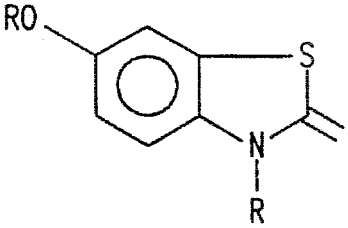
Figure 1E:
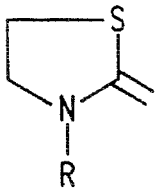
Figure 1F:
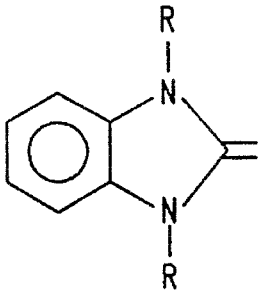
Figure 1G:
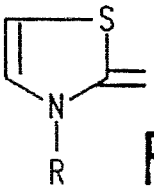
Figure 2A:
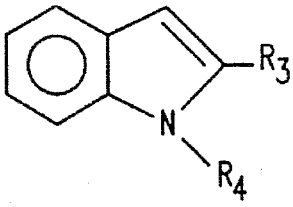
FIGS. 2A to 2E show several structural formulas of couplers for the formation of azo-dyes with a hydrazone.
Figure 5:
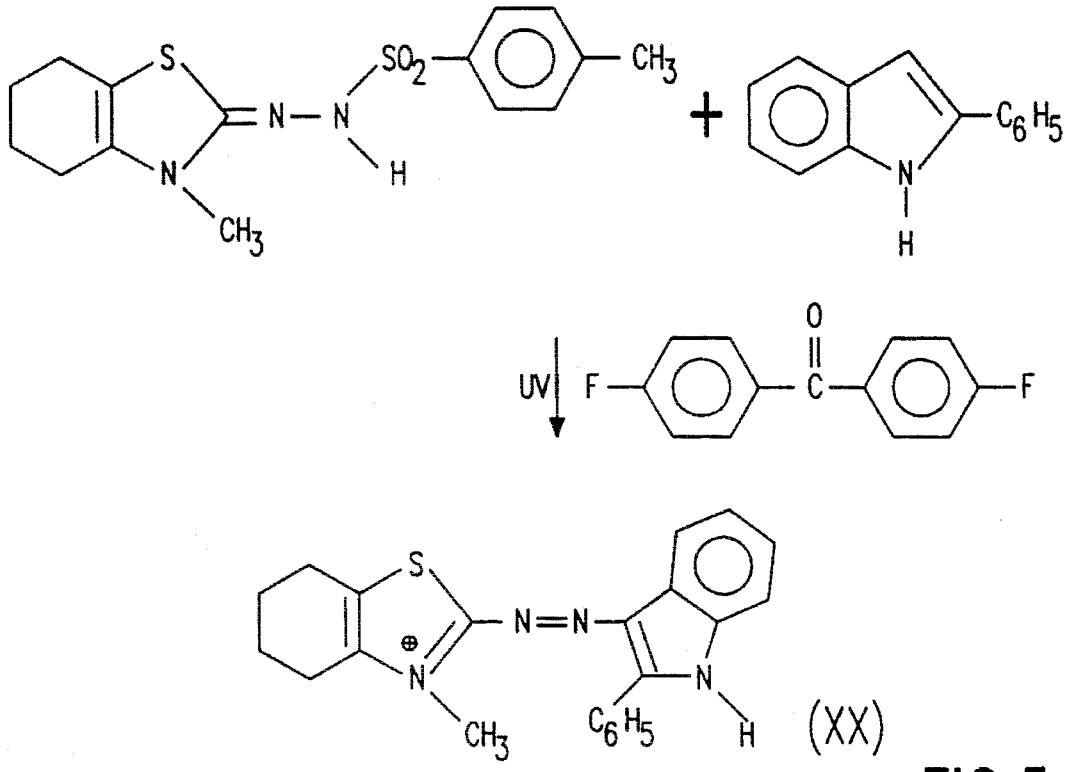
FIG. 5 shows the equation of the reaction of mono-tosylhydrazone of 4,5-tetramethylene-3-methylthiazole and 2-phenylindole, resulting in the formation of a violet azo-dye (XX)

A quantity of 0,7 wt. % of mono-tosylhydrazone of 4,5-tetramethylene-3-methylthiazole as the precursor (structural formula: FIG. 4B), 4 equivalents of 2-phenylindole as the coupler (structural formula: FIG. 2A, wherein $R_3$= phenyl and $R_4$=H) and 4 equivalents of benzophenone are suspended in a solution of 15 wt. % of polymethyl methacrylate in cyclohexanone. The mixture obtained is spin coated onto a substrate of ABS (acrylonitrile butadiene styrene). After drying, a layer having a thickness of 50 μm is obtained. After irradiation with an excimer laser (wavelength 308 nm) a violet image is obtained in the exposed parts of the layer. The reaction equation is shown in FIG. 5, in which formula XX represents the structural formula of the violet azo-dye formed.

Exemplary Embodiment 2.

Figure 6:
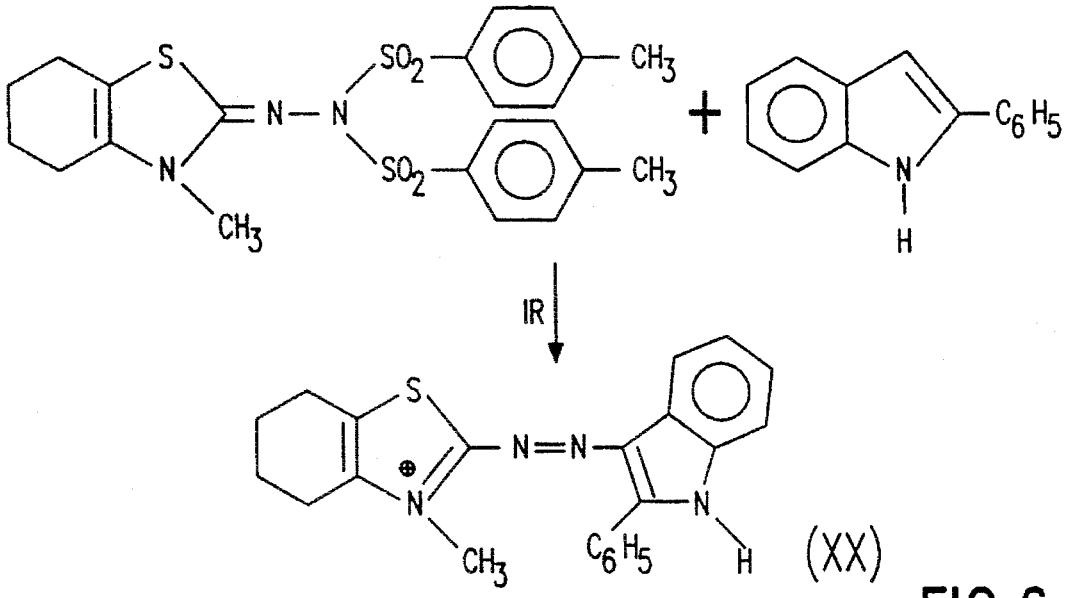
FIG. 6 shows the equation of the reaction of bis-tosylhydrazone of 4,5-tetramethylene-3-methylthiazole and 2-phenylindole, resulting in the formation of a violet azo-dye (XX)

A quantity of 4 wt. % of bis-tosylhydrazone of 4,5'-tetramethylene-3-methylthiazole as the precursor (structural formula: FIG. 3B) and 1 equivalent of 2-phenylindole as the coupler are suspended in a two-component polyurethane lacquer. The mixture obtained is spin coated onto a substrate of ABS and dried at 80° C. After drying, a layer having a thickness of 50 μm is obtained. After irradiation with a $CO_2$ laser (wavelength 10.6 μm; power 4 W/cm$^2$) a violet image is obtained in the exposed parts of the layer. The reaction equation is shown in FIG. 6, in which formula XX represents the structural formula of the violet azo-dye formed.

Exemplary Embodiment 3.

Figure 2B:
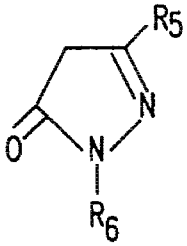
Figure 2C:
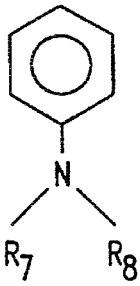
Figure 7:
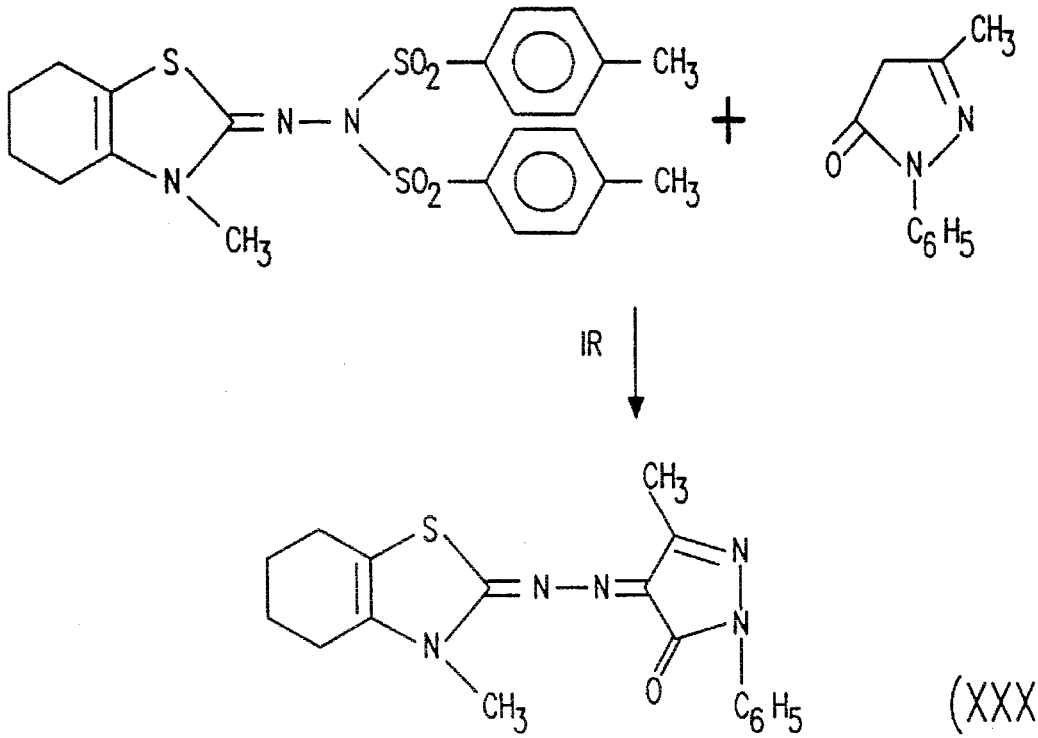
FIG. 7 shows the equation of the reaction of bis-tosylhydrazone of 4,5-tetramethylene-3-methylthiazole and 3-methyl-1-phenyl-2-pyrazoline-5-one, resulting in the formation of an orange azo-dye (XXX)

A quantity of 4 wt. % of bis-tosylhydrazone of 4,5-tetramethylene-3-methylthiazole as the precursor (structural formula: FIG. 3B) and 1 equivalent of 3-methyl-1-phenyl-2-pyrazoline-5-one as the coupler (structural formula: FIG. 2B, wherein $R_5$ - methyl and $R_6$= phenyl) are suspended in a two-component polyurethane lacquer. The mixture obtained is spin coated onto a substrate of ABS and dried at 80° C. After drying, a layer having a thickness of 50 μm is obtained. After irradiation with a $CO_2$ laser (wavelength 10.6 μm; power 4 W/cm$^2$) a clear orange image is obtained in the exposed areas of the layer. The reaction equation is shown in FIG. 7, in which formula XXX represents the structural formula of the orange azo-dye formed.

Exemplary Embodiment 4.

Figure 8:
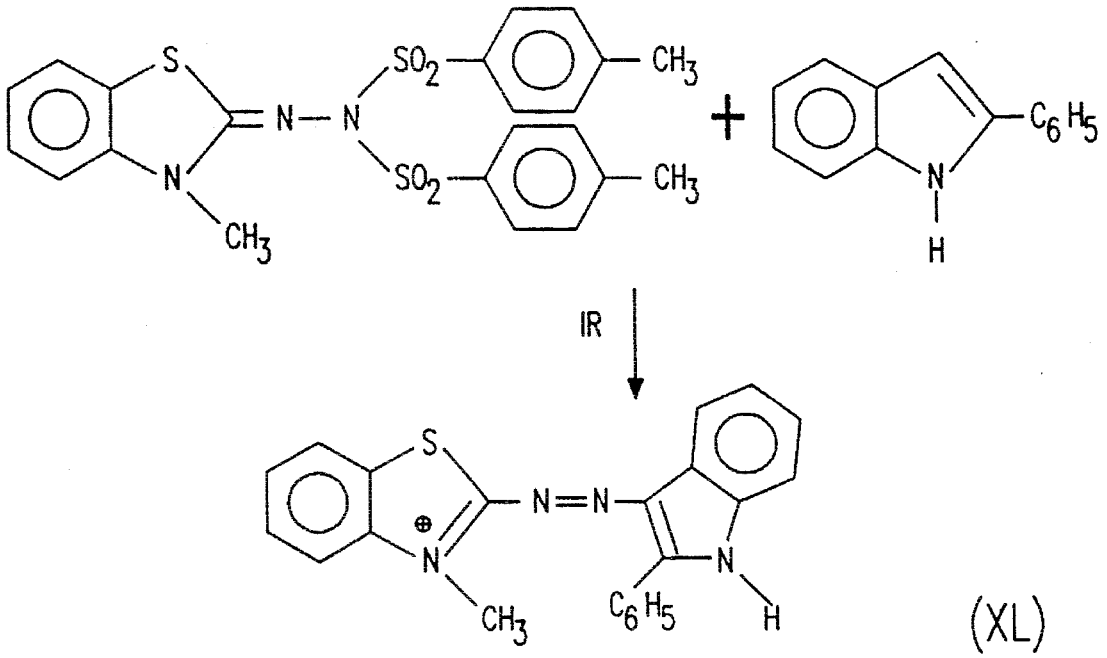
FIG. 8 shows the equation of the reaction of bis-tosylhydrazone of 3-methylbenzothiazole and 2-phenylindole, resulting in the formation of a red azo-dye (XL)

A quantity of 4 wt. % of bis-tosylhydrazone of 3-methylbenzothiazole as the precursor (structural formula: FIG. 3A) and 1 equivalent of 1-phenylindole as the coupler are suspended in a two-component polyurethane lacquer. The mixture obtained is spin coated onto a substrate of ABS and dried at 80° C. After drying, a layer having a thickness of 50 μm is obtained. After irradiation with a $CO_2$ laser (wavelength 10.6 μm; power 4 W/cm$^2$) a red image is obtained in the exposed areas of the layer. The reaction equation is shown in FIG. 8, in which formula XL represents the structural formula of the red azo-dye formed.

Exemplary Embodiment 5.

Figure 2D:
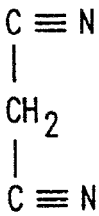
Figure 2E:
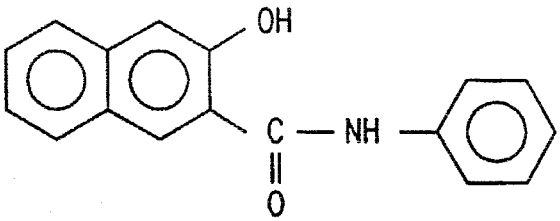
Figure 9:
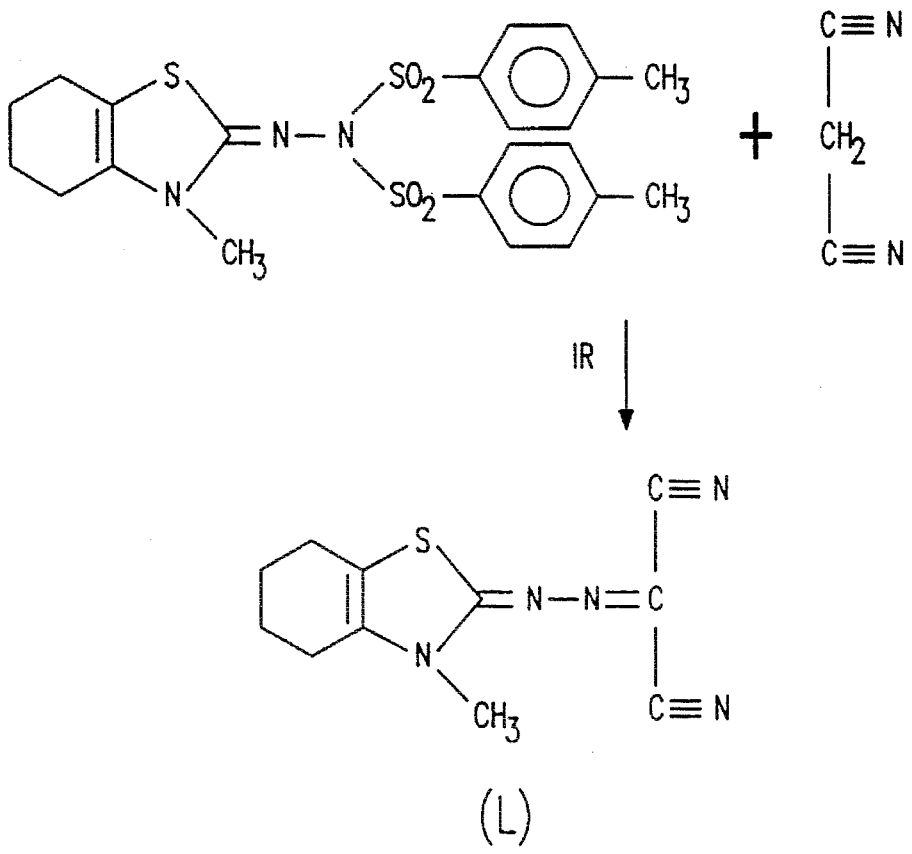
FIG. 9 shows the equation of the reaction of bis-tosylhydrazone of 4,5-tetramethylene-3-methylthiazole and malonitrile, resulting in the formation of a yellow azo-dye (L)

A quantity of 4 wt. % of bis-tosylhydrazone of 4,5-tetramethylene-3-methylthiazole as the precursor (structural formula: FIG. 3B) and 1 equivalent of malonitrile as the coupler (structural formula: FIG. 2D) are suspended in a two-component polyurethane lacquer. The mixture obtained is spin coated onto a substrate of ABS and dried at 80° C. After drying, a layer having a thickness of 50 μm is obtained. After irradiation with a $CO_2$-laser (wavelength 10.6 μm; power 4 W/cm$^2$) a yellow image is obtained in the exposed areas of the layer. The reaction equation is shown in FIG. 9, in which formula L represents the structural formula of the yellow azo-dye formed.

Exemplary Embodiment 6.

A quantity of 4 wt. % of bis-tosylhydrazone of 4,5-tetramethylene-3-methylthiazole as the precursor (structural formula: FIG. 3B) and 1 equivalent of 3-diethylaminoacetoanilide as the coupler are suspended in a two-component polyurethane lacquer. The mixture obtained is spin coated onto a substrate of ABS and dried at 80° C. After drying, a layer having a thickness of 50 μm is obtained. After irradiation with a $CO_2$ laser (wavelength 10.6 μm; power 4 W/cm$^2$) a blue image is obtained in the exposed areas of the layer.

Exemplary Embodiment 7.

A quantity of 0.7 wt. % of bis-tosylhydrazone of 4,5-tetramethylene-3-methylthiazole as the precursor (structural formula: FIG. 3B), 4-equivalents of 2-phenylindole as the coupler (structural formula: FIG. 2A, where $R_3$=phenyl and $R_4$= H) and 4 equivalents of p-nitrobenzoic acid are suspended in a solution of 15 wt. % polymethyl methacrylate in cyclohexanone. The mixture obtained is spin coated onto a substrate of ABS (acrylonitrile butadiene styrene). After drying, a layer having a thickness of 50 μm is obtained. After irradiation with a $CO_2$-laser (wavelength 10.6 μm) a violet image is obtained in the exposed areas of the layer. The reaction equation is shown in FIG. 6, in which formula XX represents the structural formula of the violet azo-dye formed. Dye to the acid medium of the layer, the colour strength is higher than it would be in the absence of p-nitrobenzoic acid.

Exemplary Embodiment 8.

Figure 10:
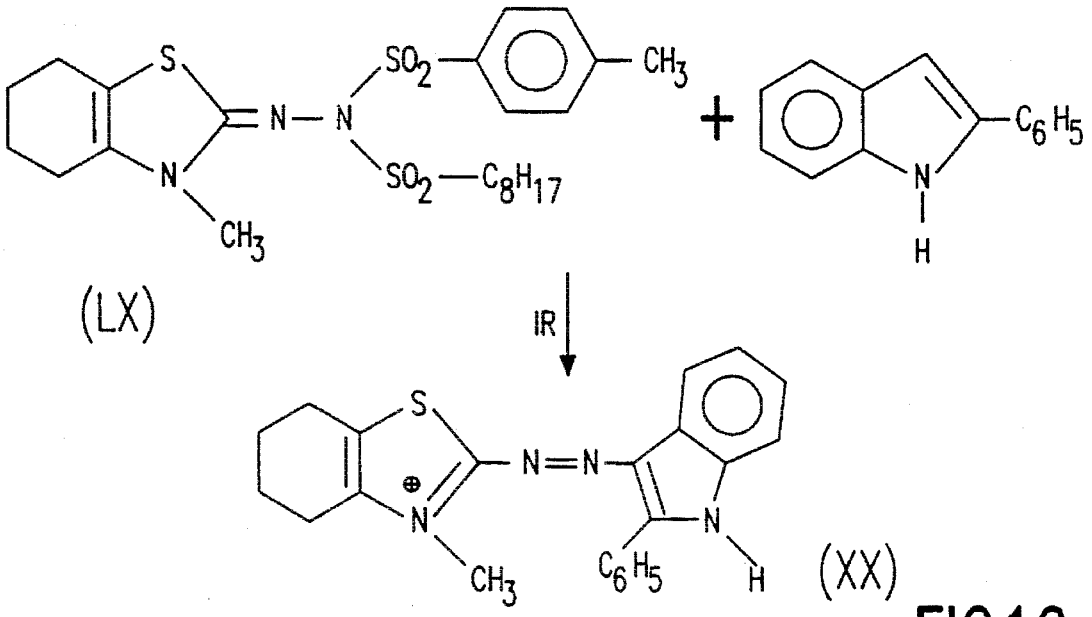
FIG. 10 shows the equation of the reaction of tosyl-octyl hydrazone of 4,5-tetramethylene-3-methylthiazole (LX) and 2-phenylindole, resulting in the formation of a violet azo-dye (XX).

A quantity of 0.7 wt. % of tosyl-octylsulphonyl hydrazone of 4,5-tetramethylene-3-methylthiazole as the precursor (structural formula: FIG. 10 (LX), 4 equivalents of 2-phenylindole as the coupler (structural formula: FIG. 2 (X), wherein $R_3$=phenyl and $R_4$=H) and 4 equivalents of p-nitrobenzoic acid are suspended in a solution of 15 wt. % polymethyl methacrylate in cyclohexanone. The mixture obtained is spin coated onto a substrate of ABS (acrylonitrile butadiene styrene). After drying, a layer having a thickness of 50 μm is obtained. After irradiation with a $CO_2$-laser (wavelength 10.6 μm) a violet image is obtained in the exposed areas of the layer. The reaction equation is shown in FIG. 10, in which formula XX represents the structural formula of the violet azo-dye formed. By virtue of the presence of the octyl group, the solubility of the precursor in the binder used is enhanced, resulting in a layer which is completely transparent after it has dried.

The substitution of an aryl group for the octyl group, as in exemplary embodiment 7, generally results in a more turbid, scattering layer. The method in accordance with the invention enables azo-dyes of any color to be formed in a simple manner by means of an IR-laser or UV-laser. An object is coated with a mixture of a precursor and a coupler in a binder, after which decorations and characters can be formed by irradiation with IR-laser light or UV-laser light.

I claim:

1. A method of marking a surface of an object comprising coating said surface with a layer of a mixture comprising at least a binder, a dye precursor and a coupler, said dye precursor being a heterocyclic bis-sulphonylhydrazone of the formula $A>C=N—NR_1R_2$ wherein A is a heterocyclic ring system, and $R_1$ and $R_2$ are selected from the group consisting of alkylsulphonyl and arylsulphonyl and said coupler being a compound having an active hydrogen atom and selected from the group consisting of indoles, phenols, anilines and methylene compounds, irradiating said mixture with a laser light beam according with the desired marking to thereby convert the dye precursor to an azo-dye at areas of said layer irradiated by said laser light beam.

2. A method as claimed in claim 1, wherein the object is made of synthetic resin.

3. A method as claimed in claim 1, wherein the binder is a polymer.

4. A method as claimed in claim 3 wherein the object is made of synthetic resin.

5. A method as claimed in claim 1 wherein the coupler is selected from the group consisting of indoles, anilines and phenols.

6. A method as claimed in claim 5 wherein the laser light is an infrared laser light.

7. A method as claimed in claim 6 wherein the object is made of synthetic resin.

8. A method as claimed in claim 5 wherein the laser light is ultraviolet laser light, and a member of the group consisting of benzophenone, 4,4'-dichlorobenzophenone and 4,4'-difluorobenzophenone is added to the layer.

9. A method as claimed in claim 8 wherein a polymer is the binder.

10. A method as claimed in claim 8 wherein the object is made of synthetic resin.

11. A method as claimed in claim 5, wherein the bis-sulphonylhydrazone is bis-tosylhydrazone of 3-methylbenzothiazole or of 4,5-tetramethylene-3-methylthiazole.

12. A method as claimed in claim 11 wherein a polymer is the binder.

13. A method as claimed in claim 11 wherein the object is made of synthetic resin.

14. A method as claimed in claim 11 wherein the laser light is infrared.

15. A method as claimed in claim 1 wherein the laser light is ultraviolet and in that also benzophenone, 4,4'-dichlorobenzophenone or 4,4'-difluorobenzophenone is added to the layer.

16. A method as claimed in claim 5 wherein a polymer is the binder.

17. A method as claimed in claim 5 wherein the object is made of synthetic resin.

* * * * *